US005335371A

United States Patent [19]

Spessard

[11] Patent Number: 5,335,371

[45] Date of Patent: Aug. 9, 1994

[54] BASEBALL INFIELDER'S MASK

[76] Inventor: Gerald W. Spessard, 19107 Wood Hill Dr., Hagerstown, Md. 21742-2845

[21] Appl. No.: 130,707

[22] Filed: Oct. 4, 1993

[51] Int. Cl.[5] ..... A41D 13/00

[52] U.S. Cl. ..... 2/9; 2/11; 2/452; 24/193; 24/115 H

[58] Field of Search ..... 2/9, 10, 11, 15, 173, 2/410, 424, 425, 452; 351/156, 157; 24/3 C, 193, 188, 115 H, 300

[56] References Cited

U.S. PATENT DOCUMENTS

| | | | |
|---|---|---|---|
| 861,170 | 7/1907 | Gamble et al. | 2/9 |
| 1,172,330 | 2/1916 | Welch | 2/9 |
| 1,186,442 | 6/1916 | Schaefer | 2/9 |
| 1,775,009 | 9/1930 | Weber | 2/9 |
| 2,715,222 | 8/1955 | Sowle | 2/9 |
| 3,770,307 | 11/1973 | Van Gompel | 24/115 H |
| 4,031,564 | 6/1977 | Wood | 2/9 |
| 4,665,590 | 5/1987 | Udelhofen et al. | 24/115 H |
| 4,736,466 | 4/1988 | Kallstrom | 2/9 |
| 5,267,353 | 12/1993 | Milligan | 2/9 |

FOREIGN PATENT DOCUMENTS

| | | | |
|---|---|---|---|
| 619661 | 5/1961 | Canada | 2/9 |
| 8707734 | 12/1987 | PCT Int'l Appl. | 351/157 |

*Primary Examiner*—Clifford D. Crowder
*Assistant Examiner*—Michael A. Neas
*Attorney, Agent, or Firm*—E. Michael Combs

[57] ABSTRACT

An infielder's mask is arranged to include use by players to include parallel bar structure directed across the mouth and nasal portions of an individual, with a bottom bar with a lowermost end of a U-shaped lower frame arranged to position about an individual's chin to position the mask in use in cooperation with strap structure,

1 Claim, 4 Drawing Sheets

BASEBALL INFIELDER'S MASK

BACKGROUND OF THE INVENTION

1. Field of the Invention

The field of invention relates to baseball mask structure, and more particularly pertains to a new and improved baseball infielder's mask wherein the same is arranged for the protection of an individual's face during a sporting event.

2. Description of the Prior Art

Mask structure for sporting events and the like are available in the prior art and have been exemplified by the U.S. Pat. Nos. 4,086,664; 3,886,596; 5,012,527; and 4,933,993.

The instant invention attempts to overcome deficiencies of the prior art by providing a mask structure configured for light-weight construction for use in the protection of an individual by the positioning of the mask relative to an individual's face and in this respect, the present invention substantially fulfills this need.

SUMMARY OF THE INVENTION

In view of the foregoing disadvantages inherent in the known types of mask structure now present in the prior art, the present invention provides a baseball infielder's mask arranged for the protective securement and mounting upon an individual's face. As such, the general purpose of the present invention, which will be described subsequently in greater detail, is to provide a new and improved baseball infielder's mask which has all the advantages of the prior art baseball mask structure and none of the disadvantages.

To attain this, the present invention provides an infielder's mask arranged to include use by players to include parallel bar structure directed across the mouth and nasal portions of an individual, with a bottom bar with a lowermost end of a U-shaped lower frame arranged to position about an individual's chin to position the mask in use in cooperation with strap structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball infielder's mask which has all the advantages of the prior art baseball mask structure and none of the disadvantages.

It is another object of the present invention to provide a new and improved baseball infielder's mask which may be easily and efficiently manufactured and marketed.

It is a further object of the present invention to provide a new and improved baseball infielder's mask which is of a durable and reliable construction.

An even further object of the present invention is to provide a new and improved baseball infielder's mask which is susceptible of a low cost of manufacture with regard to both materials and labor, and which accordingly is then susceptible low prices of sale to the consuming public, thereby making such baseball infielder's masks economically available to the buying public.

Still yet another object of the present invention is to provide a new and improved baseball infielder's mask which provides in the apparatuses and methods of the prior art some the advantages thereof, while simultaneously overcoming some the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
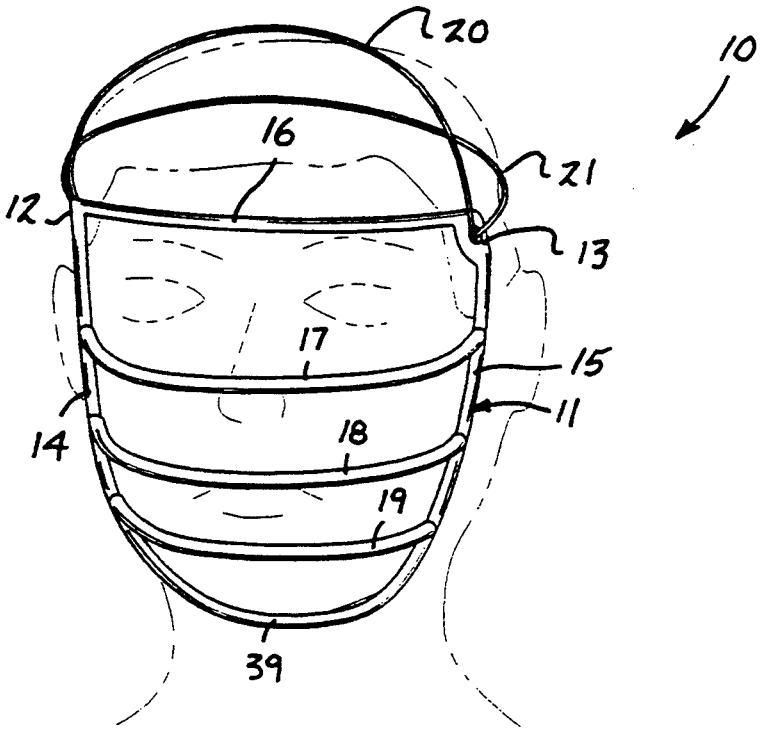
FIG. 1 is an isometric illustration of the invention.
Figure 2:
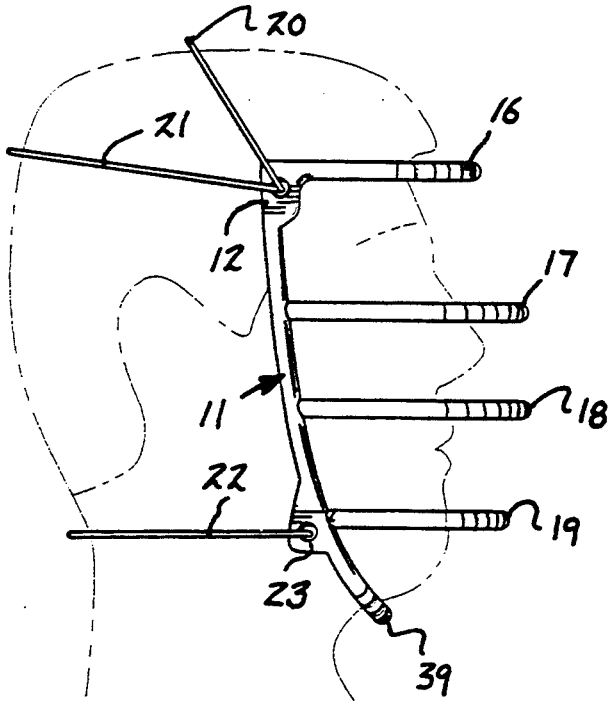
FIG. 2 is an orthographic side view of the invention.

With reference now to the drawings, and in particular to FIGS. 1 to 7 thereof, a new and improved baseball infielder's mask embodying the principles and concepts of the present invention and generally designated by the reference numeral 10 will be described.

More specifically, the baseball infielder's mask 10 of the instant invention essentially comprises a U-shaped lower frame 11 having first and second end portions 12 and 13 at an uppermost portion of the lower frame 11. The first and second end portions 12 and 13 define first and second lower frame legs 14 and 15 extending therefrom extending to a connecting bar The connecting bar 39 is canted to a third U-shaped guard frame 19 from an intersection of the third U-shaped guard frame 19 and the first and second legs 14 and 15 that it intersects. A U-shaped upper frame 16 is mounted to the lower frame first and second ends 12 and 13 respectively and is oriented at an acute angle to the U-shaped lower frame 11 as it projects forwardly thereof, with the first and second U-shaped guard frames 17 and 18 as well as the third U-shaped guard frame 19 intersecting the first and second legs 14 and 15, such that the upper U-shaped frame 16 as well as the first, second, and third U-shaped guard frames 17, 18, and 19 respectively are arranged in a parallel relationship. First strap 20 extends from the first end 12 to the second end 13, with a second strap 21 extending from the first end 12 to the second end 13 in a like manner to provide for mounting of the mask structure. The connecting bar 39 is arranged for securement to an individual's lower chin portion, with a third strap 23 extending between first and second ears 23 and 24 that are positioned at the intersection of the third U-shaped guard frame 19 and the first and second legs 14 and 15

Figure 3:
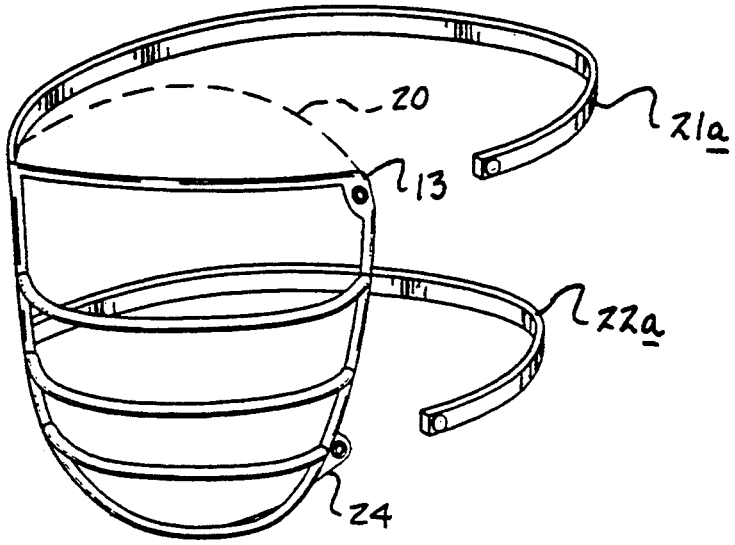
FIG. 3 is an isometric illustration of the invention employing fastener structure for the lower strap structure.
Figure 4:
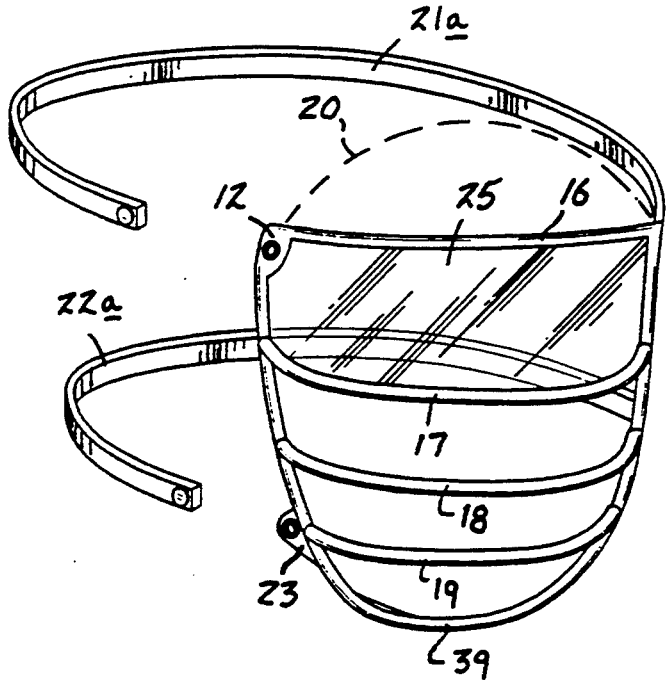
FIG. 4 is an isometric illustration indicating the straps in a separated configuration.
Figure 5:
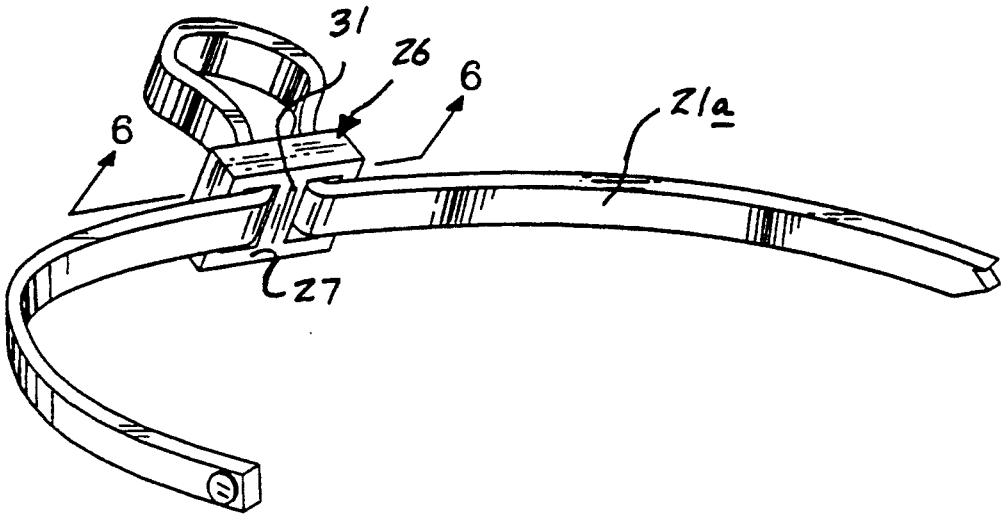
FIG. 5 is an isometric illustration of a slack adjustment block for use by the invention.
Figure 6:
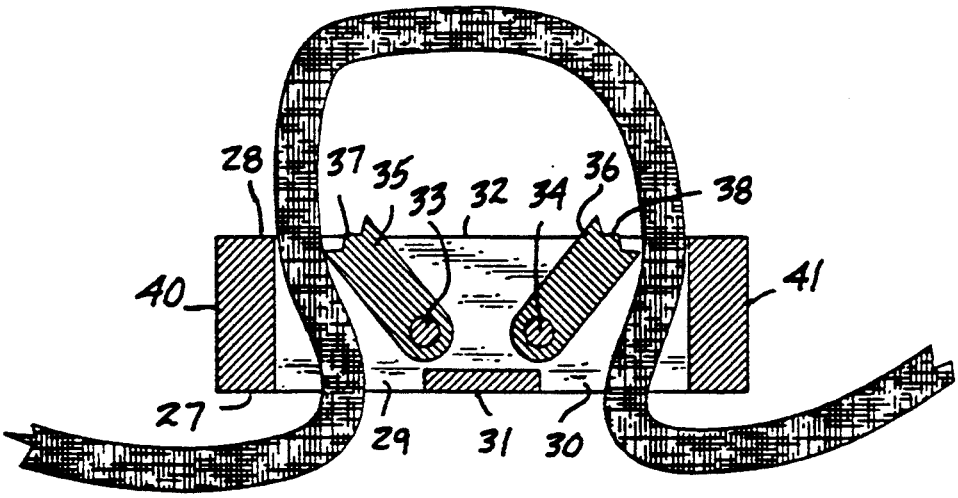
FIG. 6 is an orthographic view, taken along the lines 6—6 of FIG. 5 in the direction indicated by the arrows.
Figure 7:
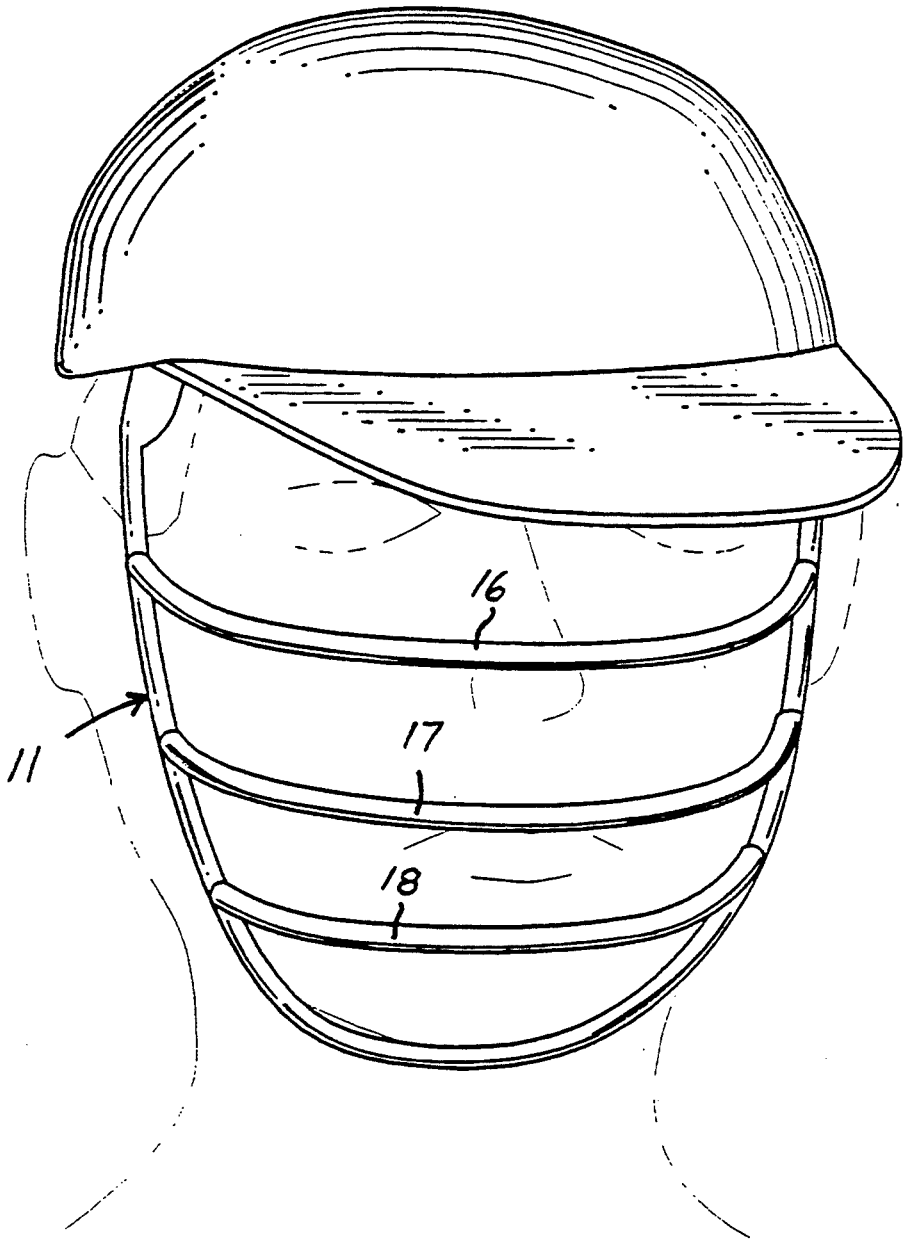
FIG. 7 is an isometric illustration of the invention in use.

The FIGS. 3 and 4 indicate the use of modified second and third straps 21*a* and 22*a* respectively, having snap fasteners at their free distal ends for securement to the first and second legs, with the second strap 21 secured to the first and second ends 12 and 13, with the modified third strap 22*a* secured to the first and second ears 23 and 24. Further, if desired, a transparent eye shield is mounted coextensively between the upper frame 16 and the first guard frame 17. The FIGS. 5 and 6 indicates the use a slack adjustment block 26 for use on at least one of the second and third strap members, such that the block 26 includes a block front wall 27 spaced from a block rear wall 28, having first and second channels 29 and 30 directed through the block from the front wall 27 to the rear wall 28 between a central bar 31 coplanar with the front wall, with the strap member projecting through the rear wall opening 32 that is substantially coextensive with the rear wall. First and second respective arresting legs 35 and 36 are pivotally mounted about respective first and second axles 33 and 34 that are fixedly mounted within the respective first and second channels 29 and 30 in adjacency to the central bar 31, with the first and second legs 35 and 36 having respective first and second leg ribbed end walls 37 and 38 to engage the strap directed through the respective first and second channels 29 and 30, such that tension applied to the strap engages the first and second end walls 37 and 38 with the block's respective first and second side walls 40 and 41.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A baseball infielder's mask, comprising, a U-shaped lower frame, having a first leg spaced from a second leg, with the lower frame having a first end and a second end at the respective first leg and second leg, with an upper frame of a U-shaped configuration extending between the first end and the second end, with the upper frame oriented at an acute angle relative to the lower frame, with the lower frame further including a U-shaped connecting bar extending between the first leg and the second leg at a respective first intersection and second intersection with the respective first leg and second leg, the first intersection having a first ear, and the second intersection having a second ear, and a first strap extending from the first end to the second end, and a second strap extending from the first to the second end, with the first strap and the second strap pivotally mounted relative to the first end and the second end, and a third strap secured to the first ear and the second ear, and a first U-shaped guard frame parallel to the upper frame, with the first U-shaped guard frame extending between the first leg and the second leg, a second U-shaped guard frame extending between the first leg and the second leg in adjacency to the first U-shaped guard frame, and a third U-shaped guard frame extending between the first leg and the second leg at the respective first intersection and the second intersection, with the first U-shaped guard frame, the second U-shaped guard frame, the third U-shaped guard frame, and the upper frame arranged in a parallel relationship, and a transparent eye shield directed coextensively between the upper frame and the first U-shaped guard frame, and at least the second strap includes a strap adjustment block with the second strap extending through the strap adjustment block, with the strap adjustment block including a block front wall spaced from a block rear wall, and a first side wall spaced from a second side wall, with a first channel and a second channel arranged in a parallel relationship relative to one another and extending between the front wall and the rear wall between the first side wall and the second side wall, and a central bar coplanar with the front wall defining the first channel between the central bar and the first side wall, and the second channel between the central bar and the second side wall, with the second strap extending through the first channel and the second channel, with the rear wall having a rear wall opening and the second strap projecting through the rear wall opening, and a first axle and a second axle mounted within respective first channel and second channel, and a first arresting leg pivotally mounted to the first channel, a second arresting leg pivotally mounted to the second axle, the first arresting leg having a first ribbed end wall, and the second arresting leg having a second ribbed end wall, with the first ribbed end wall and the second ribbed end wall arranged in engagement with the second strap.

* * * * *